US010786044B2

(12) United States Patent
Burch

(10) Patent No.: US 10,786,044 B2
(45) Date of Patent: Sep. 29, 2020

(54) FOOTWEAR WITH PROTECTIVE TOE GUARD AND RELATED METHOD

(71) Applicant: Wolverine Outdoors, Inc., Rockford, MI (US)

(72) Inventor: John H. Burch, Belmont, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 140 days.

(21) Appl. No.: 16/047,145

(22) Filed: Jul. 27, 2018

(65) Prior Publication Data

US 2019/0053577 A1 Feb. 21, 2019

Related U.S. Application Data

(60) Provisional application No. 62/546,063, filed on Aug. 16, 2017.

(51) Int. Cl.

| | |
|---|---|
| ***A43B 23/08*** | (2006.01) |
| ***A43B 7/32*** | (2006.01) |
| ***A43B 13/14*** | (2006.01) |
| ***A43B 13/04*** | (2006.01) |

(52) U.S. Cl.

CPC ..... *A43B 23/087* (2013.01); *A43B 7/32* (2013.01); *A43B 13/04* (2013.01); *A43B 13/14* (2013.01); *A43B 23/081* (2013.01); *A43B 23/082* (2013.01)

(58) Field of Classification Search

CPC ... A43B 23/087; A43B 23/081; A43B 23/082; A43B 23/086; A43B 23/07; A43B 7/32; A43B 13/04; A43B 13/14; A43C 13/14

USPC ..... 36/72 R, 77 R, 77 M, 85, 96, 107, 113; 12/146 D

See application file for complete search history.

(56) References Cited

U.S. PATENT DOCUMENTS

| | | | | | |
|---|---|---|---|---|---|
| 2,795,868 | A | * | 6/1957 | Shultz | A43B 23/082 36/77 R |
| 3,593,438 | A | | 7/1971 | Mitchell | |
| 4,735,003 | A | * | 4/1988 | Dykeman | A43B 23/087 36/77 R |
| 4,870,762 | A | * | 10/1989 | Lee | A43B 7/32 36/77 R |
| 5,074,060 | A | | 12/1991 | Brncick et al. | |
| 5,689,903 | A | | 11/1997 | Aumann | |
| 5,784,736 | A | | 7/1998 | Issler et al. | |
| 5,878,511 | A | | 3/1999 | Krajcir | |
| 5,974,697 | A | * | 11/1999 | Tseng | A43B 7/32 36/107 |

(Continued)

FOREIGN PATENT DOCUMENTS

| | | | | |
|---|---|---|---|---|
| DE | 19520272 A1 | * | 12/1996 | A43B 7/32 |
| DE | 10348983 A1 | * | 6/2005 | A43B 23/082 |

(Continued)

*Primary Examiner* — Jameson D Collier

(74) *Attorney, Agent, or Firm* — Warner Norcross + Judd LLP

(57) ABSTRACT

Footwear is provided including a protective toe element in the form of a rigid protective toe guard nested in a recess defined by a sole component so that the toe guard is of a low profile and has an at least partially closed bottom which cleanly transitions to an upper surface of the sole component. The footwear and its components provide impact and crushing force resistance, yet the footwear is low profiled and flexible enough to provide enhanced mobility and comfort to a wearer.

19 Claims, 9 Drawing Sheets

(56) References Cited

U.S. PATENT DOCUMENTS

| | | | | |
|---|---|---|---|---|
| 6,067,732 | A | 5/2000 | Dodge | |
| 6,381,876 | B2 | 5/2002 | Krajcir | |
| 6,389,715 | B1 | 5/2002 | Krajcir | |
| 6,414,195 | B1 | 7/2002 | Ueno et al. | |
| 6,834,444 | B2 | 12/2004 | Issler | |
| 2001/0007179 | A1 | 7/2001 | Mitchell | |
| 2003/0226285 | A1 | 12/2003 | Covatch | |
| 2013/0255111 | A1* | 10/2013 | Sakurai | A43B 7/32 36/77 R |
| 2016/0128424 | A1* | 5/2016 | Connell | A43B 23/0265 36/103 |
| 2017/0095032 | A1* | 4/2017 | Lacroix | A43B 3/02 |

FOREIGN PATENT DOCUMENTS

| | | | | | |
|---|---|---|---|---|---|
| GB | 2050144 | A | * | 1/1981 | A43B 23/086 |
| GB | 2071989 | A | * | 9/1981 | A43B 23/087 |

* cited by examiner

FOOTWEAR WITH PROTECTIVE TOE GUARD AND RELATED METHOD

BACKGROUND OF THE INVENTION

The present invention relates to footwear, and more particularly to safety footwear including protective toe guards.

The human foot includes many bones that can be subject to crushing forces when impacted by falling or dropped items. For example, the foot includes multiple elongated metatarsal bones in the instep region, which are further connected to phalanges associated with the toes. These bones are particularly vulnerable to fracture when impacted by falling objects. In the United States, over 100,000 individuals are injured annually due to such accidents, some being severely incapacitated or maimed.

Many manufacturers produce footwear designed to prevent injury to the toe region and instep region in general. Such footwear typically includes a protective toe element, usually in the form of a rigid metal shield placed over the toe region, such as a steel toe. The steel toe usually rests on top of a midsole, and is concealed by a fabric or leather cover that matches the remainder of the footwear. The metal shield can include a bottom that projects upward from the top of a midsole or an outsole to form an abrupt edge located under the base of the wearer's toes. Typically, a footbed or insole is placed over this edge so it is not perceivable to a wearer of the footwear. Over time however, the footbed or insole may thin, so the edge becomes noticeable to the wearer due to the edge engaging the wearer's toes or forefoot. Further, with the bottom of the steel toe above the midsole, it frequently is difficult to fully conceal the upwardly projecting edge. This can cause discomfort to the wearer, along with a stiff construction used to attach the steel toe to the midsole.

Accordingly, there remains room for improvement in the field of protective toe elements that protect the phalanges, and optionally metatarsal bones of a wearer's foot from forceful impacts, and simultaneously provides comfort, flexibility and ease of manufacture in an aesthetically pleasing package.

SUMMARY OF THE INVENTION

Footwear is provided including a protective toe element in the form of a rigid protective toe guard nested in a recess defined by a sole component so that the toe guard is of a low profile and has an at least partially closed bottom which cleanly transitions to an upper surface of the sole component. The footwear and its components provide impact and crushing force resistance, yet the footwear is low profiled and flexible enough to provide enhanced mobility and comfort to a wearer.

In one embodiment, the footwear includes an upper having an inner portion. The inner portion can be of a Strobel construction. For example, the inner portion can include a liner or other fabric portion that extends within and generally closes a void for a wearer's foot. The bottom of the liner can be closed with a Strobel board, which can be a full or partial Strobel board extending from the toe region toward the heel region of the footwear. The Strobel board can be flexible and of a minimal thickness, for example about 0.25 mm to about 2.5 mm, or other thicknesses depending on the application.

In another embodiment, the Strobel board can rest on the top and/or be in contact with an upper surface of the bottom wall of the toe guard. The Strobel board also can rest atop and/or can be in contact with an upper surface of the sole component. In this manner, the transition between the bottom wall of the toe guard and the sole component's surface can be imperceptible to a wearer of the footwear, and does not reflect through or otherwise create an abrupt transition noticeable through the Strobel board. Optionally, a footbed can be placed atop the Strobel board and can be of a similar size and shape. This footbed also can fit within the interior of the toe guard.

In still another embodiment, the inner portion of the upper attached to the Strobel board can form a closed toe box of the inner portion. The toe box can be disposed within the interior of the toe guard, optionally so that the wearer's foot cannot contact the interior surfaces of the toe guard.

In another embodiment, the upper can include an outer portion. This outer portion can extend over at least a portion of the inner portion and can be constructed from more durable material than the material of the inner portion. The outer portion can extend forwardly over an exterior of the toe guard and conceal it within the footwear.

In still another embodiment, the toe guard can include an outer perimeter. Adjacent the other perimeter, the toe guard can define a peripheral recess. A peripheral allowance of the outer portion can be nested at least partially within the peripheral recess of the toe guard. In this manner, the peripheral allowance of the outer portion can be secured within a portion of the toe guard. With a peripheral allowance in this recess, the overall profile of the toe guard can be lowered in the footwear.

In even another embodiment, the sole component, which can be a footbed, an insole, a midsole, and outsole, or any combination of the foregoing or other cushioning element underfoot, can include a toe guard recess that is configured to receive the toe guard and set it at a particular depth below an upper surface of the sole component. In this manner, the bottom of the toe guard nests within the recess so that the upper surface of the bottom wall is flush with or slightly above or below the upper surface of the sole component to provide a clean, smooth transition between the bottom wall and the upper surface, and optionally to lower the overall profile of the toe guard in the toe region of the footwear.

The footwear of the current embodiments provides a protective toe guard that is exceptionally low profiled, flexible and comfortable to wear. With its low profiled, rigid toe guard, the footwear is not overly bulky or aesthetically displeasing. The interior of the footwear is more comfortable due to its clean and imperceptible transition between the rigid toe guard bottom wall and the upper surface of the sole. Due to the clean transition, the footwear also can include a Strobel construction, with a Strobel board overlaying the bottom wall and upper surface of the toe guard's bottom wall. Where the toe guard includes a peripheral wall recess, an exterior cover can be cleanly associated with the toe guard, and can minimize bulkiness. In addition, the well-fitted, low profile toe guard renders the footwear exceptionally flexible, allowing the foot to follow a more natural range of motion during a gait cycle of the wearer.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
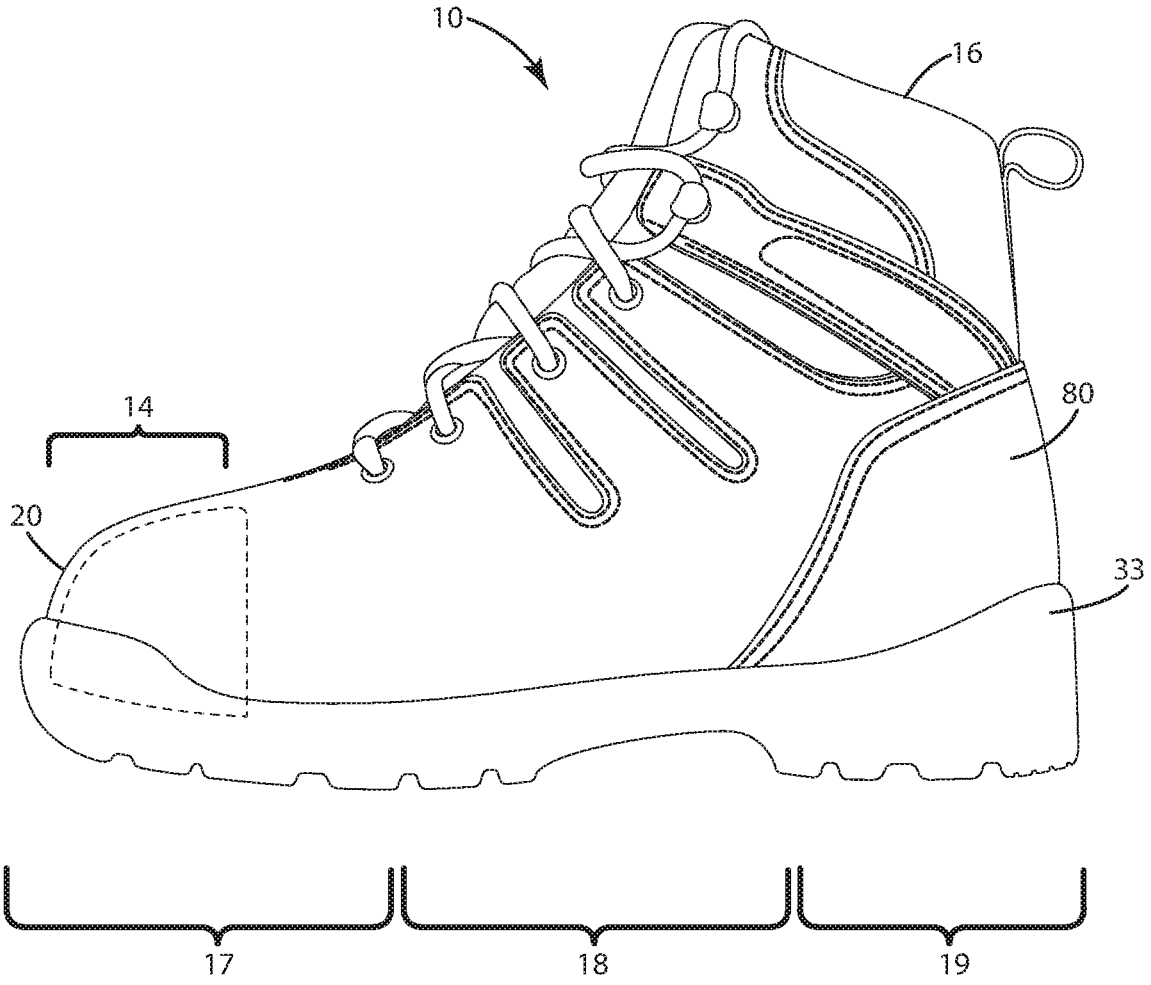
FIG. 1 is a side view of footwear of a current embodiment including a toe guard and associated features.

An article of footwear in accordance with the current embodiment is shown in FIGS. 1-7 and generally designated 10. The footwear includes an upper 20 that is joined with a sole 30. The footwear 10 also includes a protective toe element in the form of a toe guard 50.

The toe guard 50 generally can be cup shaped, and thus also referred to sometimes as a toe cup, to receive the toes WT of the wearer's foot WF when the wearer's foot is placed within the internal void 16 of the footwear 10. The toe guard 50 also can include a bottom wall 50B that is configured to be placed at least partially under the wearer's toes WT when the wearer's foot is placed within the footwear void 16. The bottom wall 50B can include an upper surface 50BU and a lower surface 50LS opposite the upper surface. The upper surface generally can be configured to face toward the wearer's toes WT, while the lower surface can face away from the wearer's toes WT underfoot. The footwear also includes the sole 30, which can be in the form of a midsole, an outsole, a footbed, or any other sole component and/or cushion element that is configured to be placed underfoot of the wearer in the footwear. The sole is configured to define a recess 30R in the forefoot region 17, and more particularly, the recess 30R can be defined in the toe region 14 of that forefoot region 17 of the footwear 10. This recess 30R can be of a depth sufficient so that when the toe guard 50 is placed in the recess 30R, the upper surface 50BU of the bottom wall of the toe guard 50 is flush with or otherwise at a common level as the upper surface 30US of the sole 30. Optionally, the bottom wall upper surface 50BU can lay substantially within the same plane P as the upper surface 30US of the sole 30. In turn, this can provide a clean and smooth transition between those two surfaces. Accordingly, when a Strobel assembly 70 having a Strobel board 75 is placed such that its toe box 70TB is within the interior 50I of the toe guard 50, the Strobel board 75 lays atop a smooth surface, without any abrupt edges, bridges or underfoot anomalies that may be perceived by the wearer of the footwear.

Figure 6:
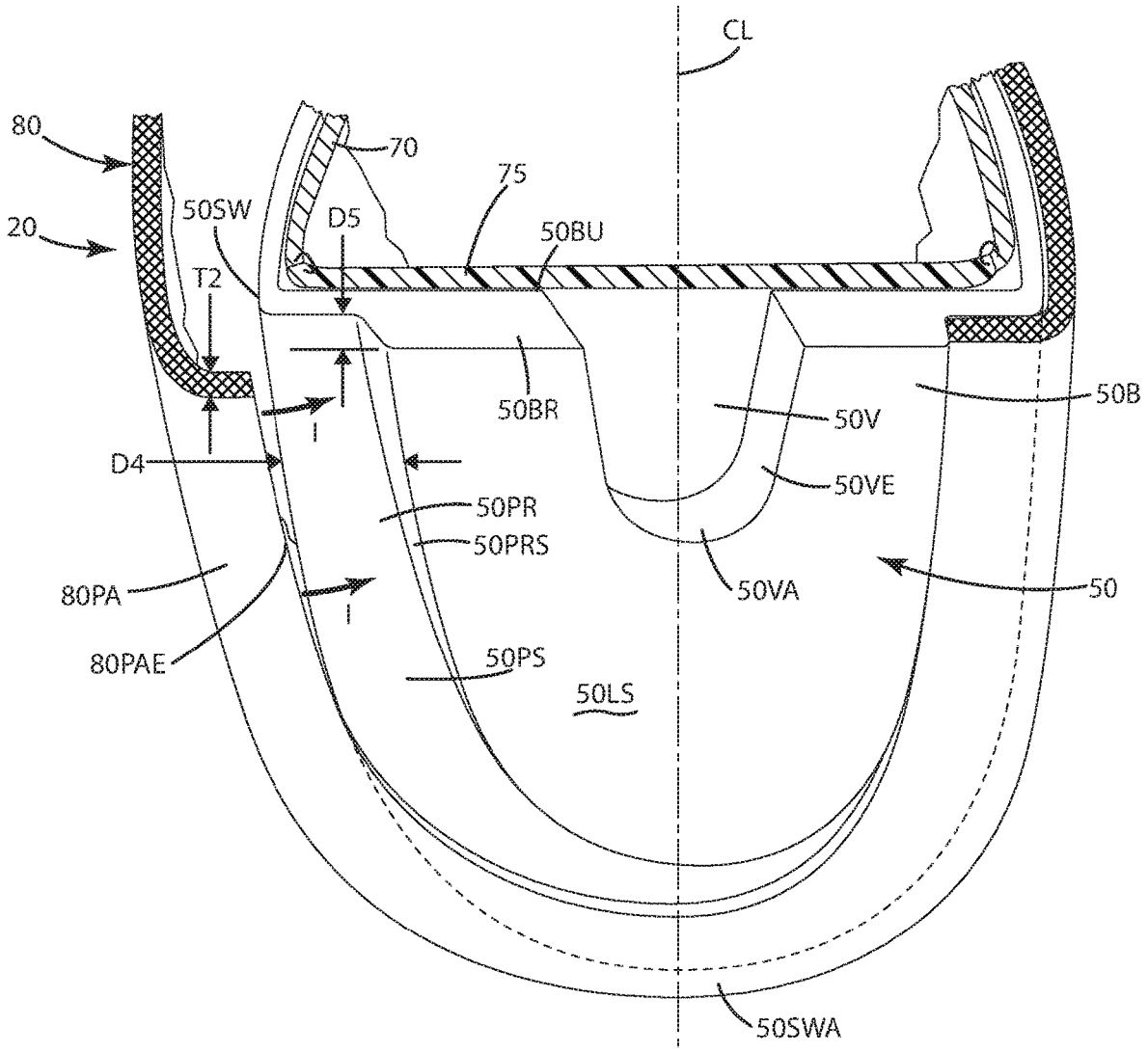
FIG. 6 is a bottom view of the toe guard with the peripheral allowance being installed in the peripheral recess of the toe guard.

As mentioned above, the toe guard 50 also can define a peripheral recess 50PR that extends at least partially around an outer perimeter of the toe guard. This peripheral recess can receive therein, as shown in FIG. 6, at least a portion of a peripheral allowance 80PA of an outer portion 80 of the upper 20. In turn, this can enable the toe guard to be placed lower and at least partially in the sole 30.

Although the current embodiments are illustrated in the context of a working boot or safety shoe, they may be incorporated into any type or style of footwear, including performance shoes, hiking shoes, trail shoes and boots, hiking boots, all-terrain shoes, barefoot running shoes, athletic shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 17, arch region or mid-foot region 18 and heel region 19, as well as the toe region 14 within the forefoot region 17, generally are identified in FIG. 1. However, it is to be understood that delineation of these regions may vary depending upon the configuration of the sole assembly and/or footwear.

As mentioned above, the phalanges and other nearby bones can be broken when impacted by objects dropped on the wearer's toes from above. Thus, the toe guard 50 herein enhances protection for these bones in the toe region 14, and more generally, the forefoot region 17.

For purposes of disclosure, the embodiments herein are described in connection with footwear in the form of a work boot 10 having an upper 20, which as mentioned above, optionally can include a Strobel construction. The upper 20 is joined with the outsole 30. The joining of the outsole 30 and the upper 20 can be accomplished using adhesives, cement, injection molding, pour molding or any other technique used to join an upper and outsole. As illustrated, the Strobel board or insole board 75 can be positioned immediately adjacent the sole 30.

Figure 2:
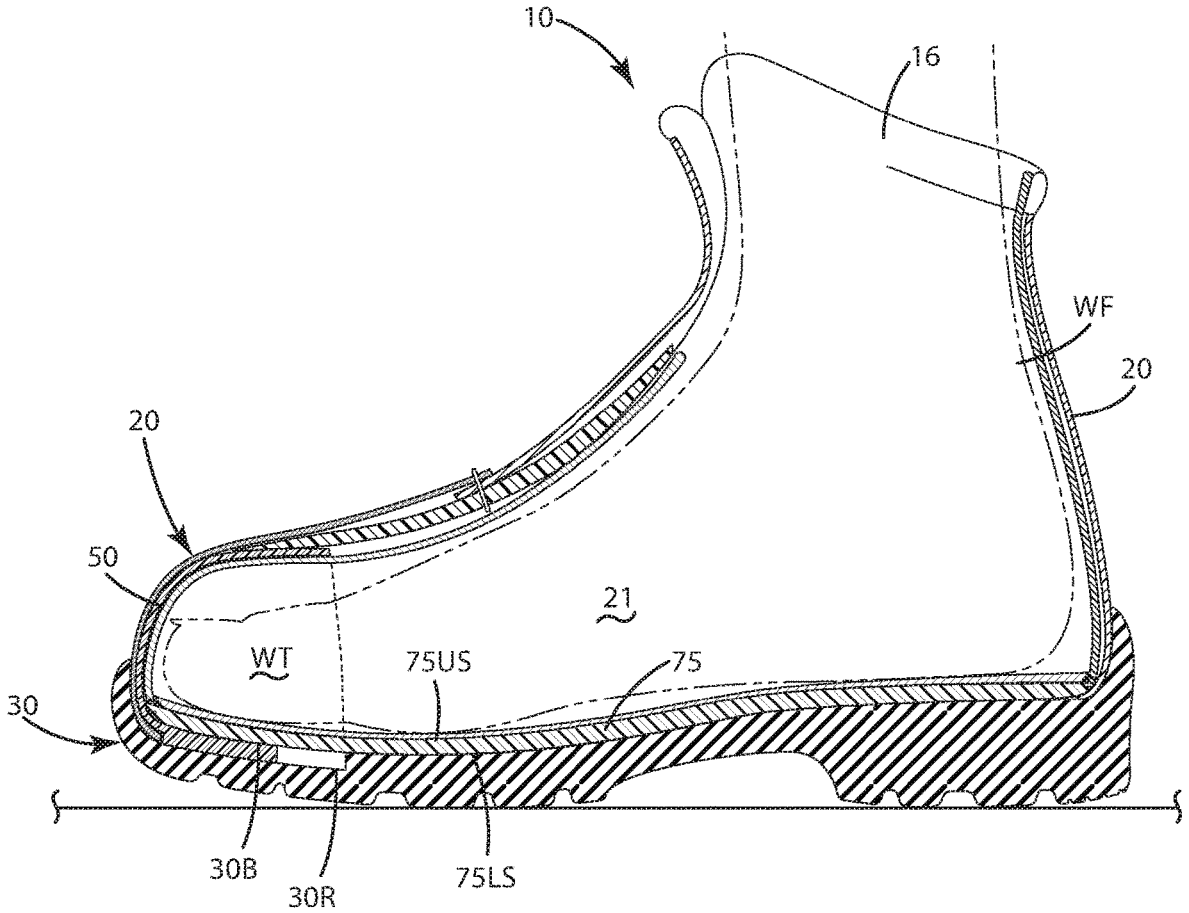
FIG. 2 is a sectional view of the footwear, the toe guard, an inner portion of the upper having a Strobel construction and a sole.
Figure 5:
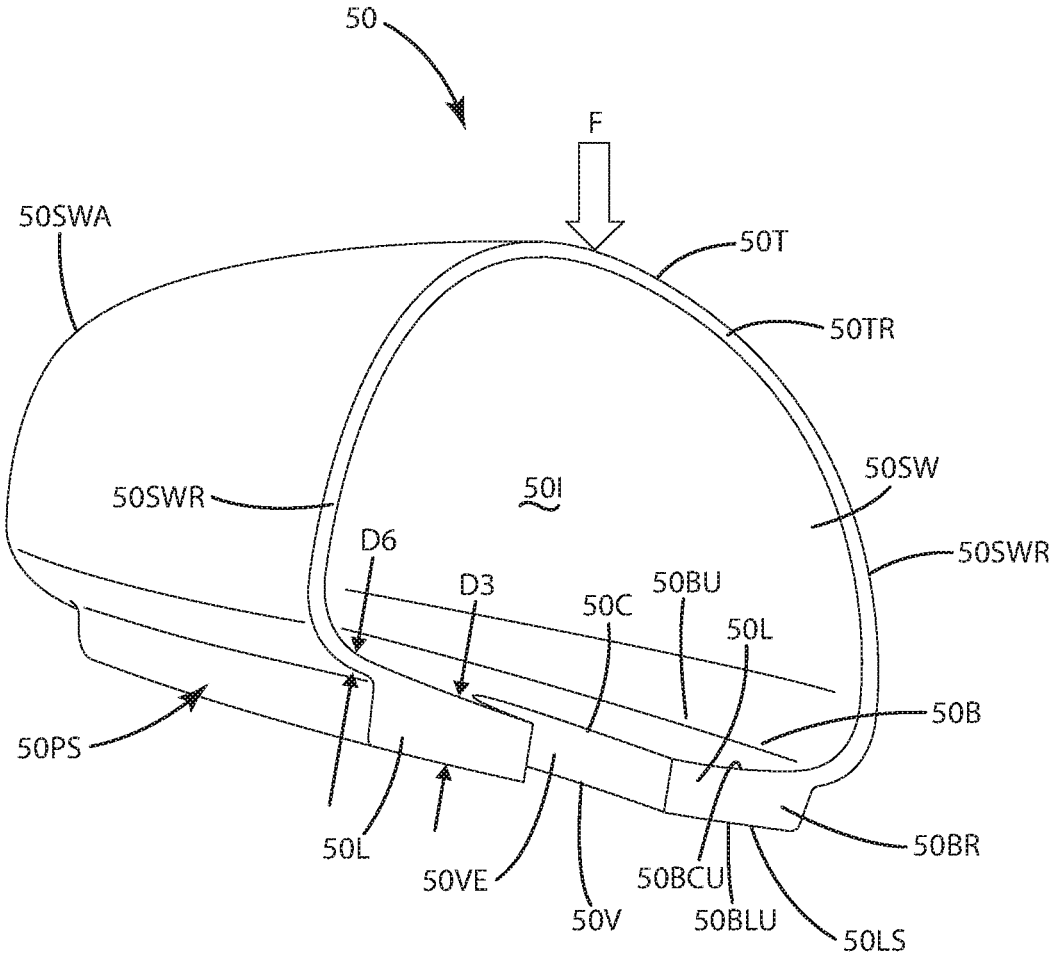
FIG. 5 is a rear perspective view of the toe guard.

As shown in FIGS. 1, 2 and 5, the upper 20 optionally includes different portions. For example the upper 20 can comprise an exterior portion 80 which covers an interior portion 70. The exterior portion 80 can be constructed from multiple different panels of a durable wear resistant material, such as leather, rubber, silicone, thermoplastic polyurethane elastomer (TPU), canvas, Kevlar® (a type of para-aramid fiber), plastic and other materials and fabrics. This outer portion 80 can generally extend through the heel region, arch region and forefoot region. A portion of this outer portion 82 also can extend over and adjacent the toe guard 50 and a corresponding toe box 70TB of the inner portion 70. The outer portion 80 also can include a peripheral allowance 80PA that can extend around the lowermost portion of the outer portion 80 of the upper 20. Generally, this peripheral allowance 80PA can form a bottom opening 83 which corresponds to the general shape of the sole of the footwear.

Figure 3:
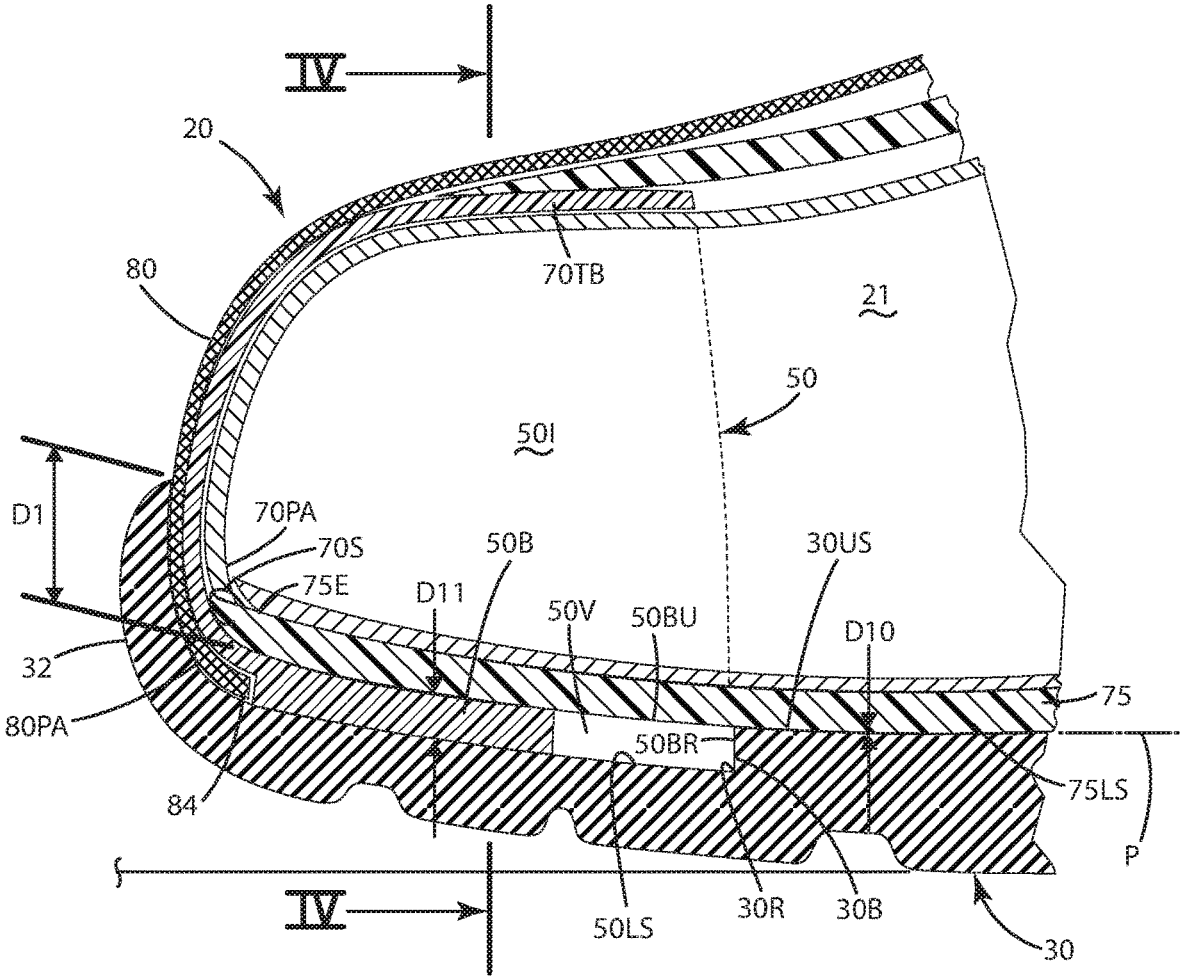
FIG. 3 is a close-up sectional view of the toe guard and its interface with the sole and outer portion of the upper.

In most cases, the peripheral allowance and its internal edge 84 can be concealed under a portion of the sole and/or the toe guard as described further below. Further, the peripheral allowance 80PA, as shown in FIG. 3, can be at least partially concealed by flange 32 of the sole 30. This flange 32 can extend upwardly a preselected distance above the bottom wall 50B of the toe guard 50. Optionally this distance D1 can be approximately 0.25 mm to 25 mm or more, depending on the particular application.

Other portions of the sole also can extend upwardly, adjacent the peripheral allowance and/or sidewalls of the exterior portion 80 of the upper. For example, as shown in the heel region 19 of FIG. 1, a rearward flange 33 can extend upward, adjacent a sidewall of the exterior portion 80 of the upper for preselected distance similar to that noted above.

As mentioned above, the upper 20 also can include an inner portion 70. This inner portion can be in the form of a liner joined with a board to generally form a Strobel construction. The Strobel construction defines a foot-receiving upper interior 21 and can be closed on its bottom or lowermost portion by a Strobel board, an insole board, sock liner 75 or other similar component. The Strobel board 75 can include an upper surface 75US and opposing lower side 75LS. The upper surface 75US can face upward toward the interior 21 of the footwear. The lower surface 75LS can face downward toward and can generally contact and/or be secured to the sole 30 with adhesives or other materials. The Strobel board can be a flexible but somewhat rigid piece or sheet of material in the shape of the bottom of a foot that is sewn around its peripheral edges to a second lower peripheral allowance 70PA of the inner portion 70. The sewing can be achieved via a stitching 70S that extends through both the peripheral allowance 70PA and the outer perimeter edge 75E of the Strobel board 75. Although not shown, the footwear 10 can include a footbed and/or other upper components with the footbed fitted into the upper 10.

The sole 30 can be disposed below the upper 20 and any optional midsole included in the sole. The sole 30 can be constructed from one or more materials. The sole 30 can be constructed from rubber and can include lugs, tread, or other gripping elements. Alternatively, it can be constructed from a thermoplastic polyurethane elastomer (TPU), nylon or other polymer blend that includes nylon and/or TPU. Of course, the outsole can be constructed from any relatively wear resistant polymer, elastomer and/or natural or synthetic rubber or other materials capable of providing the desired functional characteristics. Other materials such as fiber-reinforced polymers can be used. These can include epoxy, polyethylene, polyester, thermosetting plastic reinforced with carbon, glass and/or aramid fibers.

The footwear 10 of the current embodiment includes the rigid protective toe element or toe guard 50. This element can be a steel toe, but of course can be constructed from other materials. For example, it can be constructed from rigid polymeric materials and/or composites of sufficient thickness to deflect forces and/or loads from objects dropped on the toe. The rigid toe guard 50 can be configured to extend throughout the toe region 14 of the wearer's foot generally extending rearwardly toward the heel region 19 of the foot, but located substantially within the forefoot region 17 (FIG. 1) of the footwear 10.

Figure 4:
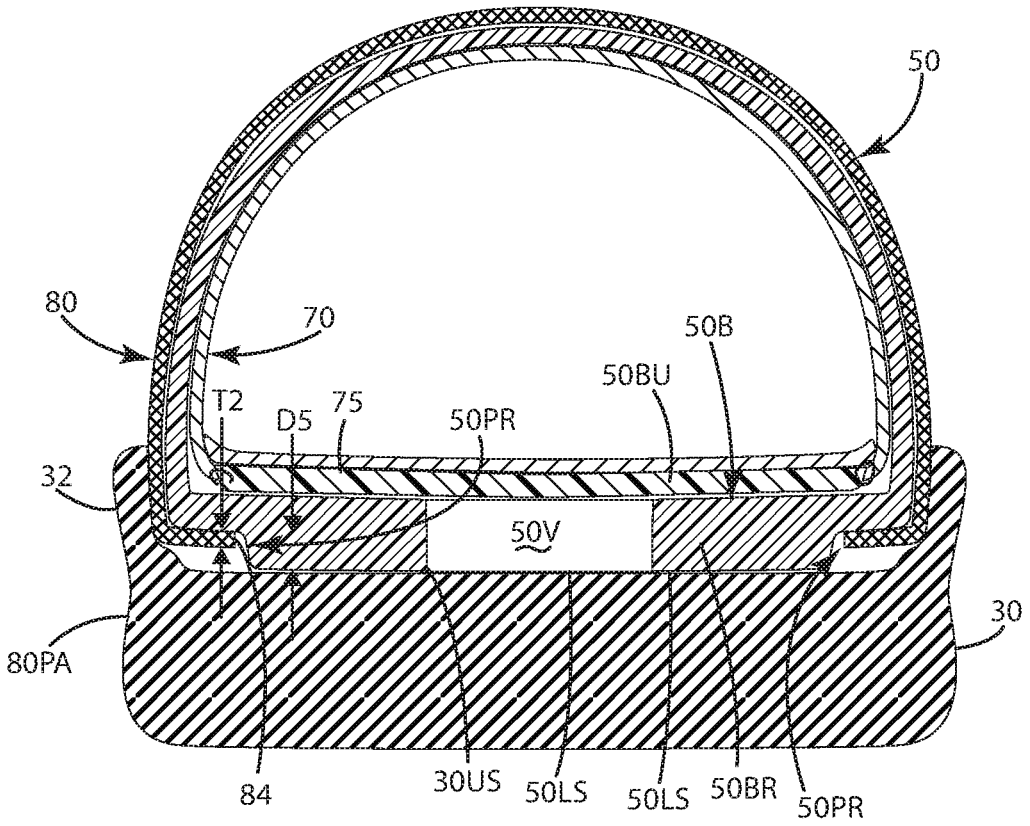
FIG. 4 is another sectional view of the toe guard, and in particular, its peripheral recess within which a peripheral allowance of the outer portion of the upper is at least partially disposed.

With reference to FIGS. 3-5, the toe guard 50 will now be described in further detail. As mentioned above, the toe guard 50 includes an interior 50I within which the wearer's toes WT can be disposed as the footwear is in use. The toe guard 50 generally can include multiple walls that face inwardly toward the interior 50I. These walls can include the bottom wall 50B as mentioned above, a sidewall 50SW and an upper or top wall 50T. The sidewall 50SW can extend upwardly from the bottom wall 50B and joined that bottom wall with the upper wall 50T. The upper wall 50T generally extends across the uppermost extremities of the wearer's toes WT when the footwear is worn. The upper wall 50T and sidewall 50SW can form an arch over the toes when extending from the lateral side to the medial side. The sidewall 50SW, upper wall 50T and lower wall 50B can form a cup-shaped opening which corresponds to the interior 50I of the toe guard 50. The sidewall 50SW also can extend forwardly to an apex 50SWA which can be the forward most portion of the toe guard 50T. This apex can be a portion of the sidewall 50SW that is rounded and extends rearward to the rearward edges 50SWR on opposite sides of the toe guard 50. These sidewall rearward edges 50SWR can be tapered, or can terminate at a squared off edge.

The upper wall 50T, as mentioned above, can be partially rounded and can be joined with the top of the sidewall 50SW. The upper wall 50T also can include a rearward edge 50TR that joins with the rearward edges 50SWR of the sidewalls. All of these edges can lie in a common plane.

As shown in FIGS. 3-6, the toe guard also includes the bottom wall 50B. As mentioned above, this bottom wall can include a bottom wall upper surface 50BU and a bottom wall lower surface 50LS. These bottom wall upper and lower surfaces can terminate at a rearward edge 50BR of the bottom wall. This bottom wall rearward edge 50BR can be in a common plane with the sidewall edges 50SWR. The rearward edge 50BR also can be constructed so that it extends generally vertically when the toe guard is included in the footwear. The upper surface 50BU can transition to the rearward edge 50BR at a rounded or angled corner 50BCU. Likewise, the bottom wall lower surface SOLS can transition to the rearward edge 50BR at a rounded or angled corner 50BLU. The upper surface and lower surface of the bottom wall can be separated by a vertical distance or thickness D3, which can be about 0.1 mm to about 10 mm, more or less, depending on the particular application. Generally, the rearward edge 50BR can be optionally void of any tapers so that the upper and lower surfaces are joined at a point or along a line. Optionally, there can be separation between the upper and lower surfaces so that the rearward edge 50BR has some thickness D3 where it terminates.

The rearward edge 50BR and the bottom wall also can define a void 50V. This void can be configured so that when a crushing, impact force F is applied to the top surface 50T of the toe guard, it translates to the sidewalls 50T and ultimately the bottom wall 50B, without the bottom wall 50B buckling or otherwise collapsing upward to further pinch the wearer's toes between the bottom wall and the upper wall of the toe guard. In some cases, the void 50V can be structured to enable the bottom wall to fracture slightly and/or dissipate force into the underlying sole 30.

Optionally, the bottom wall rearward edge 50BR includes a linear portion that transitions to a curved portion 50C adjacent the void 50V. That curved portion 50C transitions back to another linear portion 50L of the rearward edge 50BR. Although the void 50V is shown including a curved peripheral edge 50VE, that edge can include multiple compound angled, linear walls that join one another to form a generally rounded void. Further, the void 50V can, as shown in FIG. 6, form an apex 50VA at its forwardmost portion. That apex 50VA can lay on a common centerline CL of the footwear. In addition, the sidewall apex 50SWRA of the toe guard 50 also can lay on that common centerline. If desired, the void 50V can comprise less than 70% of the bottom wall upper surface 50BU. In other applications, the void 50V can comprise optionally less than 60%, further optionally less than 50%, even further optionally less than 40%, yet further optionally less than 30%, further optionally less than 20%, and yet further optionally less than 10% of the area of the upper surface 50BU of the bottom wall 50B. Although shown as a parabolic or rounded void 50V, the void can be in the shape of a triangle or a partial polygon depending on the particular application.

The toe guard 50, as mentioned above also can include a peripheral recess 50PR. This peripheral recess 50PR as illustrated in FIGS. 3-7, can extend from the rearward edge 50BR of the bottom wall 50B on a first or medial side of the toe guard all the way to the rearward edge 50BR on a second or lateral side of the toe guard. This recess 50PR can include and be defined by a shoulder 50PRS that intersects a shelf 50PS. The shelf 50PS can extend generally outwardly away from the centerline CL of the toe guard. The shelf 50PS also can be substantially parallel to the upper surface 50BU and/or the lower surface SOLS of the bottom wall. The shelf can transition to the shoulder 50PRS at a distance D4 away from the sidewall 50SW as shown in FIG. 6. This distance D4 can be optionally at least 0.1 mm, further optionally at least 0.25 mm, even further optionally 1 mm, yet further optionally at least 2 mm, still further optionally at least 3 mm, yet further optionally at least 4 mm, still further optionally 5 or 10, 20 or more millimeters depending on the thickness of the peripheral allowance 80PA that fits into and is housed within at least a portion of that peripheral recess 50PR. The shoulder 50PRS can transition to the bottom surface 50LS of the bottom wall 50B.

Optionally, the rearward edge can be substantially perpendicular to the bottom wall upper surface 50BU, as well as the bottom wall lower surface SOLS. Further, the shoulder 50PRS can be substantially perpendicular to the shelf SOPS and the lower surface SOLS. In some cases, the lower surface SOLS can be separated from the shelf SOPS by distance D5 as shown in FIG. 6. This distance D5 can be equal to or greater than the thickness T2 of the peripheral allowance 80PA. This can enable the peripheral allowance to nest within the peripheral recess 50PR. The lowermost surface of the peripheral allowance 80PA also can be flush with or raised relative to the lower surface SOLS. In the completed footwear, this enables the lower surface SOLS of the toe guard 50 to substantially lay the same plane as the exterior surface of the peripheral allowance 50PA.

Although shown as extending around the toe guard adjacent the sidewall 50SW, the peripheral recess 50PR optionally can extend in different proportions around the toe guard 50. For example, the peripheral recess 50PR can extend only on the lateral and medial sides of the toe guard. In other cases, the peripheral recess may extend rearward from the apex a preselected distance from that apex, and not reach the rearward edge 50BR of the toe guard 50.

FIGS. 4 and 6 illustrate the fitment of the peripheral allowance 80PA of the exterior portion 80, and the bottom wall 50B of the toe guard 50. As shown there, the peripheral allowance is nested within the peripheral recess 50PR of the bottom wall. The thickness T2 of the peripheral allowance 80PA can be less than or equal to the distance D5 of the depth of the peripheral recess 50PR. Accordingly, when the sole upper surface 30US is adhered to the lower surface SOLS of the bottom wall, the peripheral allowance 50PA nests in the recess, and does not produce a bump or abrupt transition along that lower surface SOLS of the bottom wall. In this manner, that peripheral allowance 50PA is tucked into and neatly joined with the bottom wall in the peripheral recess 50PR. Optionally, this peripheral allowance 80PA can be glued, cemented, riveted, fastened, stapled or otherwise joined to the shelf SOPS and/or the shoulder 50PRS associated with the peripheral recess 50PR. The sole upper surface 30US likewise can be cemented, adhered, molded or otherwise joined with the lower surface SOLS of the bottom wall and adjacent the peripheral allowance 80PA. As shown in FIG. 4 as well, the sole can include a phalange 32 that extends upwardly along the sides of the exterior portion 80 and above the peripheral allowance 80PA a preselected distance. Again, this preselected distance can vary depending on the desired protection along the front, sides or rear of the footwear, whenever the flange is located.

Further optionally, as shown in FIG. 5, the bottom wall 50B can have varying thicknesses. For example, between the bottom wall upper surface 50BU and the bottom wall lower surface 50LS, the bottom wall can be of a thickness D3 and a second thickness D6. The thickness D3 can be greater than the thickness D6, due to the recess 50PR defined in the bottom wall in the area or region of the thickness D6. In some cases, the thickness D3 can be the same as the thickness D6, but in those cases, the upper surface 50BU can include an upper recess, inward from the shoulder 50PRS of the peripheral recess. In this case, the central region of the upper surface 50BU can be sunken within the toe guard.

Figure 7:
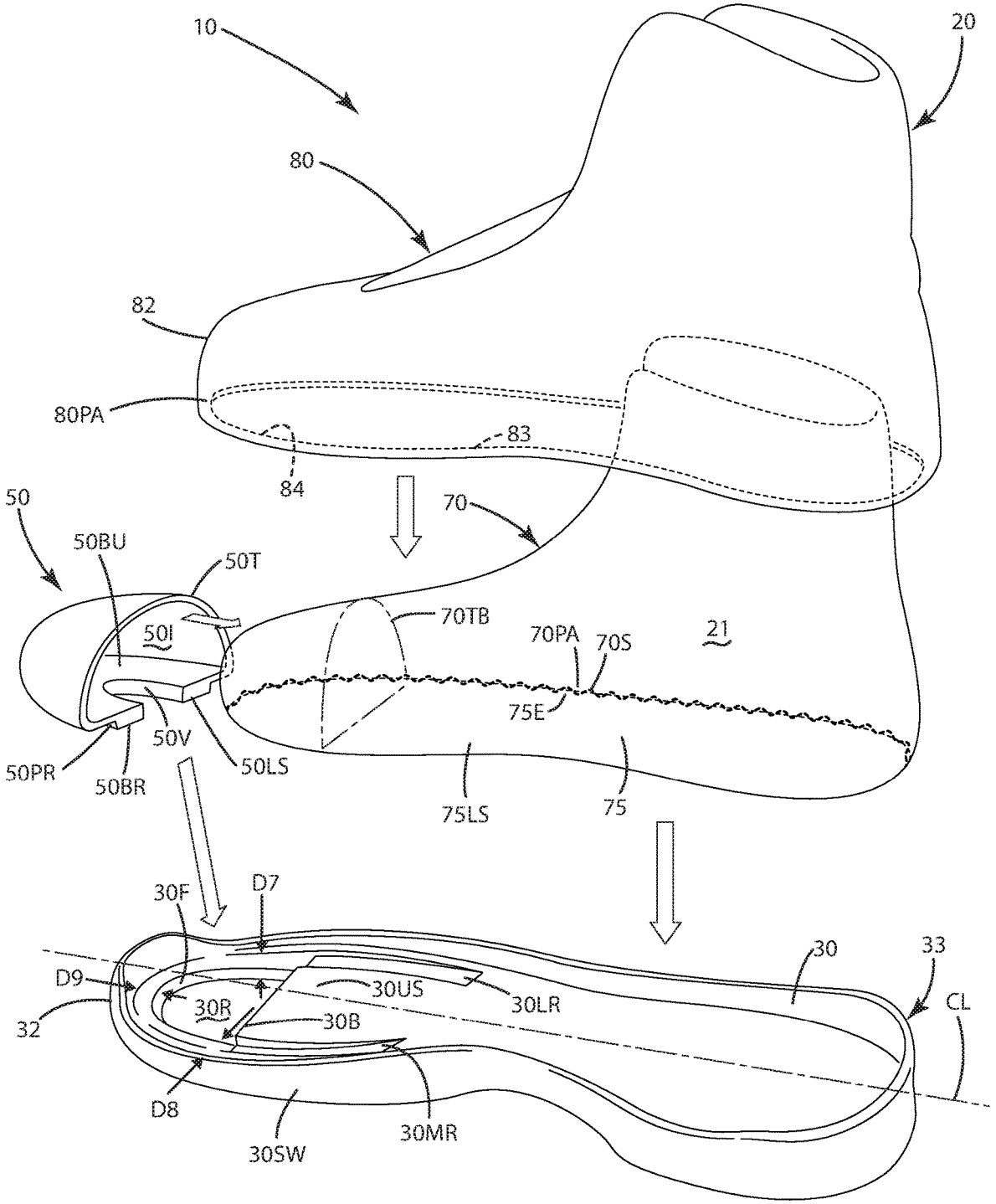
FIG. 7 is an exploded view showing assembly of the footwear.

As mentioned above, the toe guard 50 is configured to nest or be disposed at least partially within the recess 30R defined by the sole 30. As shown in FIGS. 3 and 7, the sole defines the recess 30R in a forefoot portion 17, in particular in the toe region 14, of the footwear. This recess 30R can extend downward from the upper surface 30US of the sole 30. The recess can be disposed rearwardly a distance from the flange 32. The recess can include an arcuate forward wall 30F that extends from a medial side of the footwear to the lateral side of the footwear, generally in the toe region 14. This curved wall can transition to a generally planar and/or linear rearward wall 30B. This wall can extend laterally from the medial side of the footwear to the lateral side of the footwear generally crossing a centerline or central longitudinal axis CL of the footwear. Optionally the recess 30R can be of a depth D7, which extends downwardly from the upper surface 30US of the sole to a bottom wall 30L. The depth D7 of the recess 30R can be substantially continuous around the front wall 30F and the rearward wall 30B. Of course, in some cases, the depth D7 can vary depending on the profile of the bottom wall 50B or the overall height of the toe guard 50. Optionally, the depth D7 also can be greater than or equal to the thickness D3 of the bottom wall. In some cases, the depth D7 also can be greater than the thickness D6 of the bottom wall as shown in FIG. 5. Generally, with the thickness of the bottom wall 50B being less than or equal to the depth D7 of the recess 30R, defined by the sole, when the toe guard 50 and its bottom wall are placed at least partially in the recess 30R, the upper surface 50BU of the bottom wall 50B can be flush with and in a common plane P with the upper surface 30US of the sole 30.

When the toe guard is assembled relative to the sole, as shown in FIG. 3, the rearward edge 50BR is adjacent and optionally abuts the back wall 30B of the recess 30R. Indeed, in some cases, this abutment and contact between the rearward edge and the back wall can operate as an indexing feature to ensure that the toe guard is properly aligned relative to the remainder of the footwear. Although not shown, in some applications, the back wall 30B optionally can include a protrusion that extends into the recess 30R and corresponds to the void 50V. If this protrusion is included, it can further assist in indexing the and aligning the toe guard with the sole 30.

Optionally, as shown in FIG. 7, the upper surface 30US of the sole 30 can define lateral and medial recesses 30LR and 30MR. These recesses can be in communication with and open into the recess 30R. These recesses can be configured to ramp upward or become a shallower depth transitioning from the recess 30R rearward toward the heel region. These recesses can be sized to receive at least a portion of the peripheral allowance 80PA of the exterior portion of the upper. The peripheral allowance can be nested within those lateral and medial recesses to provide a further lower profile to the toe guard and portion of the upper in the forefoot. Although not shown, the lateral and medial recesses can extend rearwardly all the way around the periphery of the sole upper surface 30US. In turn, this can provide further concealment and nesting of the peripheral allowance in those recesses which can also assist in further lowering the profile of the footwear in the rearward and heel regions. In some cases, these lateral and medial recesses can intersect the rear wall 30B a location and can be of the same depth D7 as the recess 30R itself. In other cases, these lateral and medial recesses can be certain proportions of the depth D7 of the recess 30R, depending on the application and the configuration of and thickness of the peripheral allowance.

As shown in FIG. 7, the recess 30R defined in the upper surface 30US of the sole 30 can be positioned inward from the flange 32 a distance D9. The recess and its front wall 30F also can be set inward relative to the exterior sidewall 30SW of the sole 30 by distance D8. These distances, D8 and D9, can be equal to one another. In other cases, the distances can be different from one another, with one greater or lesser than the other.

The current embodiment of footwear 10 with its protective toe guard 10 also lends itself well to quick, easy assembly. With reference to FIG. 7, the footwear 10 can be assembled as follows. The exterior portion 80 of the upper 20 can be constructed. Various pieces of material, such as leather, canvas, and other materials can be joined together to form that component. Generally, the bottom of the exterior portion 80 includes an opening 83 which is surrounded at least partially by peripheral allowance 80PA. An internal boot or liner, optionally in the form of the inner portion 70 can be constructed. This construction can be made by joining the inner portion 70 along its peripheral allowance 70PA with an edge 75E of a Strobel board 75 using stitching 70S. This interior portion 70 can be secured to the exterior portion 80 via stitching, cement, fasteners or other attachment mechanisms.

The inner portion and exterior portion can be installed on a last (not shown). With the Strobel construction of the interior portion 70 on the last, the exterior portion 80 can be moved upward slightly so as to expose the toe box 70TB of the interior portion 70. In some cases, the toe portion 82 can be rolled back up over the instep of the last with the exterior portion in this position, a technician can then push the toe guard 50 onto the toe box 70TB of the interior portion 70. In turn, the toe box 70TB inserts into and is surrounded within the interior 50I of the toe guard 50. Optionally, cement can be applied to the Strobel board 75 in the region of the toe box 70TB before this installation, so the Strobel board can readily join with the upper surface of the bottom wall 50BU.

When the Strobel board sits within the protective toe 50 as shown in FIG. 3, Strobel board can contact and be placed first distance D10 from the sole 30 rearward of the toe guard 50. Forward of the rearward edge 50BR of the bottom wall 50, however, the lower surface 75LS of the Strobel board 75 can be placed a second distance D11 from the sole 30. This distance D11 is greater than the distance D10 and different therefrom. Optionally, the distance D10 can be about 0.0 to about 0.5 mm, while the distance D11 can be substantially equal to the depth D3 of the bottom wall as described above. Further optionally, in this construction, the Strobel board 75 can be spaced different distances from the sole in different regions of the footwear. As an example, in the toe region, the Strobel board and its lower surface 75LS can be placed at a greater distance from the sole 30 in the arch region or heal region of the footwear, where the Strobel board can directly contact and be at an effective zero distance from the sole.

With the toe guard 50 installed in the toe box 70TB, the inner portion 70 and the outer portion 80 can be manipulated so that the peripheral allowance 80PA is brought downward and extends around the bottom portion of the upper 20. For example, as shown in FIG. 6, the peripheral allowance 80PA is installed in direction I around the toe guard 50. The peripheral allowance itself is placed within the peripheral recess 50PR of the toe guard 50. This peripheral allowance 80PA is stretched over this region so that it is placed adjacent the support shell 50S. Optionally the interior edge 80PAE is pushed inward so that it abuts against the shoulder 50PRS of the toe guard 50. Optionally, this peripheral allowance can be cemented, glued or otherwise tacked or fastened to the toe guard here. The peripheral allowance rearward of the toe box also can be folded inward against the lower peripheral allowance 70PA of the inner portion 70. That peripheral allowance 80PA also can be sewn, glued or otherwise attached to the Strobel board 75, and in particular, its bottom surface along the edge 75E. In turn, this can complete the construction of the upper 20.

With the upper so constructed, it may be joined with the sole 30. To do so, as shown in FIG. 7, the Strobel board 75 is placed against the upper surface 30US of the sole, generally between the flanges 32 and 33 in the toe and heel portions of the footwear. The bottom wall 50B is also placed within the recess 30R. In so doing, the lower surface SOLS of the bottom wall engages the bottom surface 30L of the recess 30R in rests within it. The rearward edge 50PR is placed adjacent the rearward wall 30B of the recess 30R. In some cases, it can abut and/or be placed immediately adjacent and in contact with that wall. Optionally, cement can be placed in the recess 30R and over the upper surface 30US of the sole 30 before placing these items adjacent one another.

As shown in FIGS. 3 and 4, the flange 32 of the sole can be placed immediately adjacent the forward portion of the toe guard 50 and can conceal the peripheral allowance 80PA of the outer portion 80 of the upper 20. Where the lateral and medial recesses or channels 30LR and 30MR are present, the peripheral allowance 80PA of the exterior portion also can be disposed within those voids.

The recess 30R enables the bottom wall 50B, and in particular, the bottom wall upper surface 50BU to be leveled with and substantially within a common plane P with the upper surface 30US of the sole. This in turn enables the Strobel board 75 to be substantially flat and featureless, without any abrupt or noticeable or perceivable edges or ridges underfoot in the region of transition between the bottom wall in the upper surface of the sole. Due to the recess and inner fitment of the toe guard at least partially within the recess, the overall profile in height of the toe guard top wall 50T above the upper surface 30US of the sole 30 is diminished when compared to conventional steel toes that are simply placed atop the upper surface of a sole.

Figure 8:
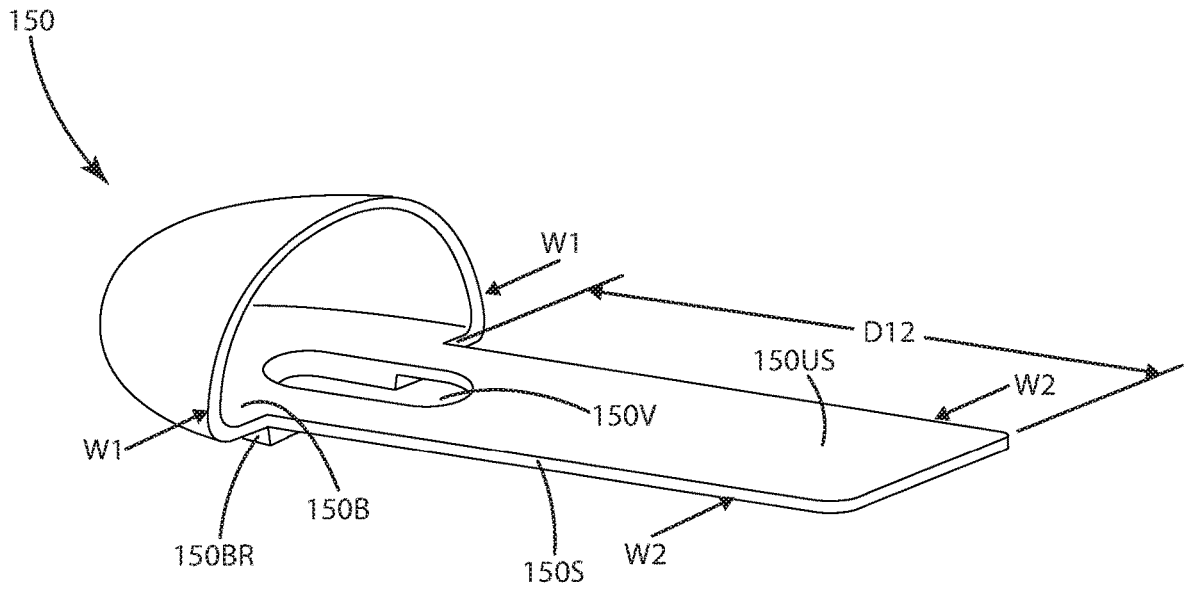
FIG. 8 is a perspective view of the first alternative embodiment of the footwear including a modified toe guard having an integral shank extending therefrom.
Figure 9:
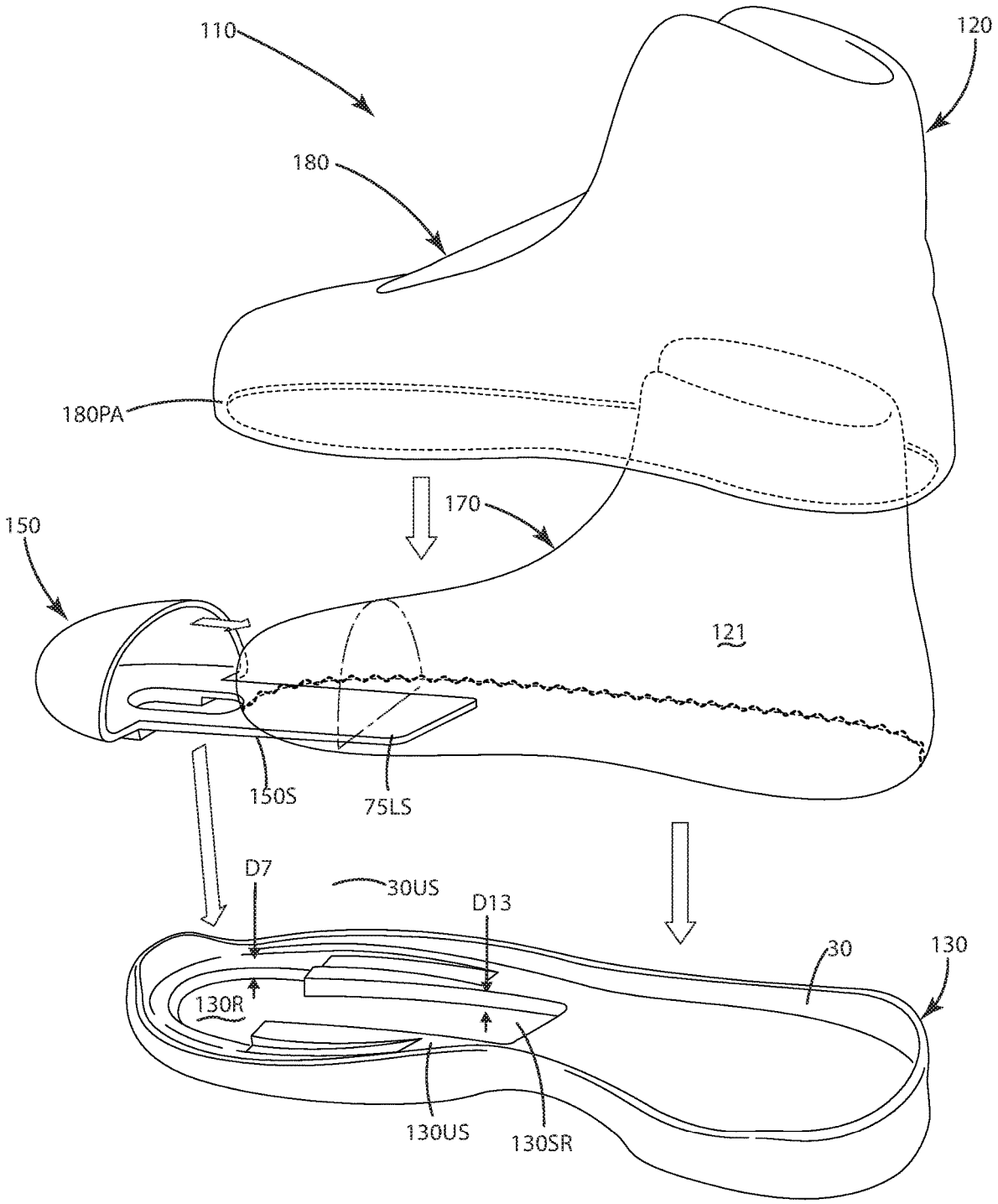
FIG. 9 is a side exploded view of the first alternative embodiment view of the footwear showing assembly of the footwear with the toe guard plus integral shank.

A first alternative embodiment of the footwear is illustrated in FIGS. 8 and 9 and generally designated 110. This embodiment is similar to the above embodiment in function, structure and operation with several exceptions. For example, the toe guard 150 can include a bottom wall 150B. The bottom wall 150B also can define a peripheral recess 150PR. This peripheral recess can conceal and fit within it the peripheral allowance 180PA similar to the embodiment above. In addition, the toe guard 150 can include a rearwardly extending integral shank 150S. The shank 150S can extend a distance D12 rearward from the rearward edge 150BR of the bottom wall 150B. This distance D12 can vary depending on the application, but it generally extends sufficiently so that the shank 150S extends into the arch region 118 of the footwear, so that it can be supported under an arch of the wearer in the finished footwear 110. Optionally, the shank 150 can extend rearward about 5 mm to about 45 mm, further optionally about 8 mm to about 25 mm, and even further optionally about 10 mm to about 20 mm rearward from the rearward edge 150BR. The shank can be of a width W2 that is less than the width W1 of the toe guard 150 as shown in FIG. 8. The shank also can be of a thickness T6 that is less than the thickness or depth D3 of the bottom wall of the toe guard. Optionally, the shank can be narrower than and thinner than the bottom wall 50B of the toe guard in some applications. Of course, this can vary depending on the intended use. The shank and bottom wall can define the void 150V. This void can extend rearward into the forward portion of the shank 150S as shown. This can lighten the overall weight of the chain and toe guard combination. Additional holes and voids can be defined elsewhere in the shank 150S depending on the application.

Referring to FIG. 9, the sole 130, and in particular the recess 130, are defined in the upper surface 130US of the sole and can be modified to accommodate the shank 150S. For example as illustrated, the upper surface 130US can define a shank recess 130SR that extends rearwardly from the toe guard recess 130R. This shank recess can be of a depth D13 that is less than or equal to the depth T6 in some applications. When assembled, the shank 150S is placed within the recess 130SR. The upper surface of the shank 150US generally can be parallel and/or flush with the upper surface 130US of the sole 130. In this manner, the rigid components of the toe guard and the shank can be below the upper surface 130US of the sole and flush with that same surface. Again, this can reduce and/or eliminate the perception of the these components under the Strobel board to a wearer of the footwear 10.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper including an interior portion and an exterior portion, the interior portion including a first lower peripheral allowance, the exterior portion including a second lower peripheral allowance;

a sole including a sole upper surface, the sole upper surface defining a sole recess in a forward portion of the sole configured to correspond to a location of a plurality of toes of a wearer of the article of footwear; and a protective toe guard constructed from a rigid material, the toe guard including a toe guard exterior and defining a toe guard interior compartment configured to receive the plurality of toes of the wearer of the article of footwear, the protective toe guard including an upper wall and a sidewall extending from the upper wall to a bottom wall, thereby generally forming a cup shape, the upper wall configured to extend over a plurality of tops of the plurality of toes, the bottom wall including a bottom wall upper surface and a bottom wall lower surface, the bottom wall including a rear edge extending from the bottom wall upper surface downward to the bottom wall lower surface, a void extending between the rear edge of the bottom wall and a rear wall of the sole recess, the void extending from the bottom wall upper surface downward to the bottom wall lower surface, wherein the protective toe guard is at least partially disposed in the sole recess so that the bottom wall upper surface is flush with the sole upper surface, wherein the interior portion of the upper is disposed in the toe guard interior compartment, wherein the exterior portion of the upper is disposed adjacent the toe guard exterior in an overlapping manner so as to conceal at least a portion of the protective toe guard.

2. The article of footwear of claim 1, wherein the bottom wall upper surface and the sole upper surface lay in a common plane.

3. The article of footwear of claim 1 comprising:

a Strobel board joined with the first lower peripheral allowance.

4. The article of footwear of claim 3, wherein the Strobel board includes a Strobel board upper surface and a Strobel board lower surface, wherein the Strobel board lower surface extends over and adjacent the bottom wall upper surface and over and adjacent the sole upper surface.

5. The article of footwear of claim 4, wherein the Strobel board lower surface is adhered to the bottom wall upper surface and the sole upper surface.

6. The article of footwear of claim 1, wherein the bottom wall lower surface includes a peripheral shoulder that defines a peripheral recess in the bottom wall lower surface.

7. The article of footwear of claim 6, wherein the first peripheral allowance is disposed in the toe guard interior compartment, wherein the second peripheral allowance is disposed on the toe guard exterior, and at least partially within the peripheral recess.

8. The article of footwear of claim 1, wherein the bottom wall rear edge extends from a first portion of the sidewall on a medial side of the protective toe guard toward a second portion of the sidewall on a lateral side of the protective toe guard;

wherein the void extends forwardly from a rearmost extent of the bottom wall between the first and second portions of the sidewall, whereby the void is configured to deform when an impact force is transferred from the sidewall to the bottom wall.

9. The article of footwear of claim 1, wherein the rear edge includes a linear portion and a curved portion extending toward an apex of the toe cup away from the linear portion, wherein the void is defined by the curved portion of the rear edge.

10. An article of footwear comprising:

an upper including an interior portion and an exterior portion;

a protective toe guard in the form of a toe cup including a bottom wall and a sidewall joined with the bottom wall extending upward to an upper wall that is configured to extend over a plurality of toes of a wearer of the article of footwear, the bottom wall including a bottom wall upper surface and an opposing bottom wall lower surface, the bottom wall including a rear edge extending from the bottom wall upper surface downward to the bottom wall lower surface; and a sole including a sole upper surface, the sole upper surface defining a recess having a perimeter of a length sufficient to extend around the bottom wall of the toe cup, a void between the rear edge and a rear wall of the recess, the void extending from the bottom wall upper surface downward to the bottom wall lower surface, wherein the interior portion is closed at a bottom portion with a Strobel board, the Strobel board extending into the toe cup over the bottom wall, wherein the toe cup is nested in the recess within the perimeter of the recess, wherein the sole upper surface is either:

(i) flush with the bottom wall upper surface of the toe cup, or (ii) above the bottom wall upper surface of the toe cup.

11. The article of footwear of claim 10, wherein the sole upper surface is flush with and lays in a common plane with the bottom wall upper surface such that the Strobel board is in a substantially planar configuration in a region where the Strobel board bridges from the sole upper surface to the bottom wall upper surface.

12. The article of footwear of claim 11, wherein the rear edge has a first thickness, wherein the perimeter of the recess adjacent the rear edge has a first depth, wherein the first thickness is less than or equal to the first depth so that the rear edge does not protrude above the sole upper surface.

13. The article of footwear of claim 11, wherein the recess is surrounded by the sole upper surface, wherein the sole includes a peripheral sidewall that extends upwardly adjacent the exterior portion of the upper a preselected distance, concealing at least a portion of the exterior portion adjacent a lower peripheral allowance of the exterior portion.

14. The article of footwear of claim 11, wherein the exterior portion includes a lower peripheral allowance, wherein the toe cup bottom wall defines a peripheral recess extending from a first portion of the rear edge of the bottom wall, forwardly around an apex of the toe cup, to a second portion of the rear edge of the bottom wall distal from the first portion of the rear edge, wherein the lower peripheral allowance of the exterior portion is disposed within the peripheral recess.

15. The article of footwear of claim 14, wherein the lower peripheral allowance extends within the peripheral recess toward the rear edge and beyond the rear edge adjacent the upper surface of the sole.

16. The article footwear of claim 11, wherein the exterior portion includes a lower peripheral allowance, wherein the toe cup bottom wall defines a peripheral recess extending adjacent the perimeter of the recess, wherein a first portion of the lower peripheral allowance is nested in the peripheral recess, wherein a second portion of the lower peripheral allowance extends beyond the toe cup toward an arch region and is positioned adjacent the upper surface of the sole.

17. The article of footwear of claim 16, wherein the rear edge includes a linear portion and a curved portion extending toward an apex of the toe cup away from the linear portion, wherein the void is defined by the curved portion of the rear edge.

18. The article of footwear of claim 17, wherein the linear portion of the rear edge abuts the rear wall of the recess.

19. The article of footwear of claim 10, wherein the bottom wall of the toe guard has a varying thickness, including a first thickness at the rear edge of the bottom wall and a second thickness at a periphery of the bottom wall where the sidewall meets the bottom wall, wherein the first thickness is greater than the second thickness.

* * * * *